United States Patent [19]

Norris

[11] Patent Number: 4,544,099

[45] Date of Patent: Oct. 1, 1985

[54] FLOW CONTROL VALVE

[76] Inventor: Harold R. Norris, 6, Elstree Way, Borehamwood, Hertfordshire, England, WD6 1SB

[21] Appl. No.: 532,535

[22] Filed: Nov. 9, 1983

Related U.S. Application Data

[63] Continuation of Ser. No. 255,988, Apr. 20, 1981, abandoned.

[51] Int. Cl.[4] ..... B05B 1/30

[52] U.S. Cl. ..... 239/271; 138/43; 138/46; 239/533.1; 239/570

[58] Field of Search ..... 239/533.1, 590.5, 570, 239/271, 571, 542, 533.13; 138/37, 39, 45, 44, 43, 42, 46; 137/454, 455

[56] References Cited

U.S. PATENT DOCUMENTS 3,482,785 12/1969 Chapin et al. ..... 239/542

*Primary Examiner*—Andres Kashnikow
*Assistant Examiner*—Mary Beth O. Jones
*Attorney, Agent, or Firm*—James C. Wray

[57] ABSTRACT

A valve device to control fluid through a passageway under a pressure head which may vary, has at least one vane which lies in the passageway to restrict the fluid flow. The vane is effectively flexible and resilient to deflect under fluid flow and so increase its restricting effect on increase in the pressure head and decrease its restricting effect on decrease in the pressure head so as to maintain a substantially constant flow output through the passageway.

The valve device may be incorporated in a nozzle for insertion as one of a series along the length of an irrigation pipe, and the nozzle may be provided with a pointed head part and an outlet tube or cap.

The device also has application in other forms of fluid control.

1 Claim, 10 Drawing Figures

FIG. 1
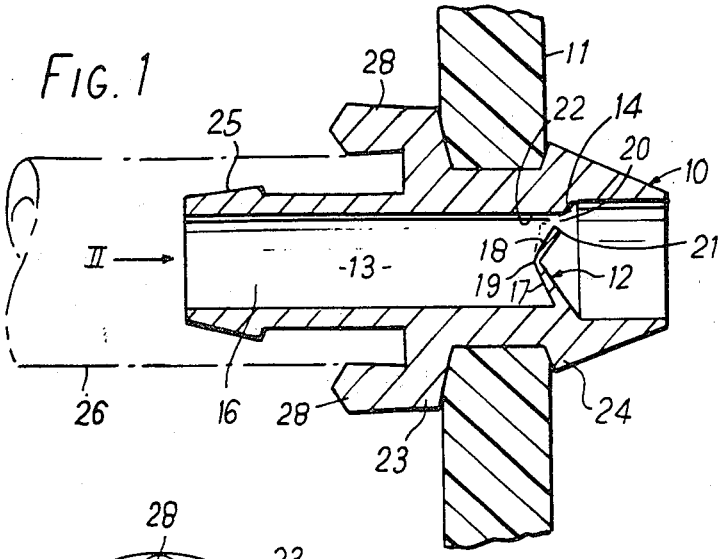
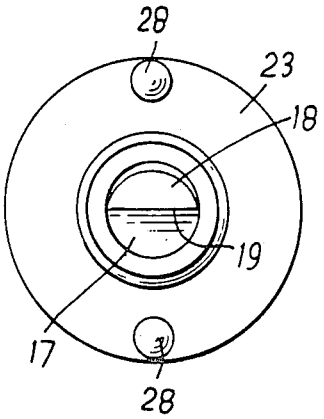
FIG. 2
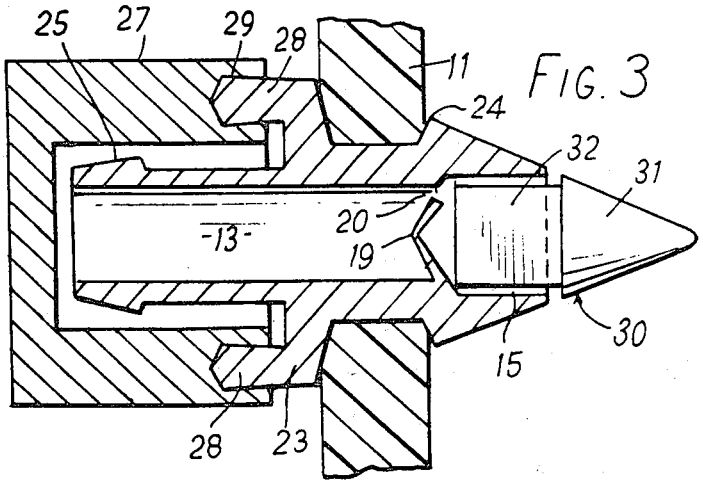
FIG. 3

FLOW CONTROL VALVE

This application is a continuation, of application Ser. No. 255,988, filed Apr. 20, 1981, now abandoned.

This invention relates to flow control valves and, more particularly, to pressure-compensating automatic flow-control valve devices.

It is one object of the present invention to provide flow control valve devices for use in irrigation systems where a series of flows, possibly to individual plants, should be maintained at steady drip rates despite differences in the distances from the source of the supply to individual nozzles and also despite possible variations in supply pressure and in the levels of the supply lines.

The invention has other applications, not only in the control of the flow of liquids, but also in the control of the flow of gases or vapours.

According to the present invention there is provided a valve device to control fluid flow through a passageway under a pressure head which may vary, the device having at least one vane which lies in the passageway to restrict the fluid flow, characterised in that said vane is effectively flexible and resilient to deflect under fluid flow and so increase its restricting effect on increase in the pressure head and decrease its restricting effect on decrease in the pressure head so as to maintain a substantially constant flow output.

For an irrigation system the vane or vanes may be mounted in, and possibly integral with, a nozzle member for insertion as one of a series into a water supply pipe.

Suitably, the vane or vanes are formed of flexible and resilient plastics material, and are angled towards the direction of fluid flow so as to create turbulence which increases with flow rate and thus provides a further variable resistance to flow. The action of the vane(s) may also provide a self-cleaning effect.

The vane or vanes may extend from a base portion in the passageway of a nozzle member, or from the base portion of an insert in the passageway of a nozzle member, and a range of nozzle members or inserts having vanes varying in number, size, thickness, position and/or angle to influence the restrictive effect may be provided.

Embodiments of the invention will now be described, by way of example, with reference to the accompanying drawings in which:

FIG. 1 is a fragmentary cross-section, to an enlarged scale, showing one of the valved nozzles in an irrigation pipe, in accordance with the present invention;

FIG. 2 is a view in the direction of the arrow II in FIG. 1;

FIG. 3 is a cross-section showing the valved nozzle provided with a head and cap;

Figure 4:
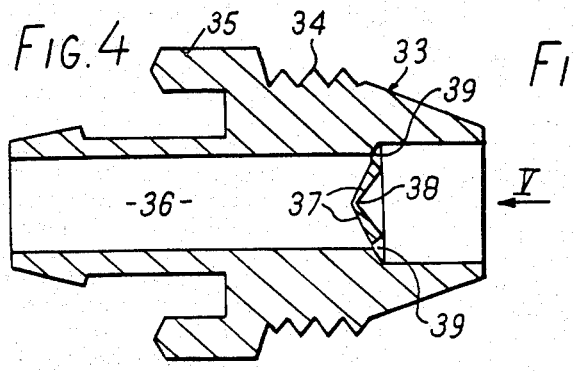
FIG. 4 is a cross-section showing another form of valved nozzle according to the invention.

Referring to FIGS. 1 and 2 of the drawings, a series of nozzles 10 (of which only one is illustrated) are inserted into wall openings spaced along the length of an irrigation pipe 11. Nozzles of this general kind are already known for feeding drops of water to individual plants or areas to be irrigated. It will be appreciated that, in non-compensating irrigation systems, i.e. systems with convention nozzles, the flows through the individual nozzles usually vary quite substantially; such variations can arise firstly because of the different substances between the source of the water supply and the individual nozzles, secondly because of fluctuations in delivery pressure and, thirdly, because of variations in the level of the supply lines.

According to the present invention, however, each nozzle 10 is provided with an integral vane 12 to promote steady and uniform flows through all the nozzles in the pipe 11.

The valved nozzle 10 is formed with a circular-section passageway 13 stepped at 14 and having an inlet length 15 and an outlet length 16. The vane 12 is formed as an angled base part 17 extending round its annular periphery from the stepped section of the valve body, and a reversely angled flap 18 which is the active part of the vane. The base 17 and the flap 18 are of almost semicircular form, and have relatively narrow cross-sections which increase outwardly from the diametrical junction 19.

As shown in full lines in FIG. 1, the vane 12 restricts the passageway quite substantially, but leaves a significant crescent-shaped gap 20 between its free periphery 21 and the opposed face 22 of the passageway.

In use of the valved nozzles of the invention, water flows from the interior of pipe 11, through the passageway 13, passing through the gap 20 between the vane and the face 22. If, however, there is an increase in the delivery pressure, the vane flap 18 will flex from its full-line position to the broken-line position shown, and thus further restrict the flow through the passageway; it will be appreciated that the restriction effected by the vanes increases in proportion to the increase in water pressure/flow. The resilient and flexible plastic material, such as the acetyls or polyester resins from which the valved nozzle may be formed, and by appropriately positioning and dimensioning the vane in relation to the adjacent passageway, produces the degree of flexing required. It has been found that with the form of valve device shown in FIGS. 1 and 2, the optimum results can be obtained if the section of the vanes increases outwardly to promote flexing at its roots at the junction 19.

As shown, the vane flap 18 is angled at approximately 60 degrees to the passageway axis, and this angling produces turbulence in the flow of water through the passageway. When the flow speed increases, the turbulence also increases to restrict flow further, and the combined restrictions contribute to an approximately steady and uniform output from all the nozzles 10 along the pipe 11.

It will also be appreciated that the water pressure in the pipe 11 will be substantially higher at the end of the pipe near the water supply point than at the remote end of the pipe. Here again, the valve device according to the invention restricts the flow at the nearer or higher-pressure points in relation to the remote or lower-pressure points, and promotes uniform outputs along the length of the pipe.

The valved nozzle is held in position by the pierced wall of the pipe 11 being sandwiched between an annular flange 23 and an annular shoulder 24 on the body of each nozzle, and a similar but smaller shoulder 25 is formed at the outer end of the valve for use in attaching an optional delivery tube 26 to promote accurate delivery of the flow.

It is also to be noted that the valved nozzle illustrated in FIGS. 1 and 2 can be used to connect aligned lengths of small-bore tube (not shown). In such a connection, the ends of the valve body are pushed into open ends of the tubes which are then held in position by the shoulders 24 and 25.

FIG. 3 shows a cap 27 which can be attached to the valve body by means of two spigots 28 extending from the flange 23 to enter snap-in sockets 29 in the cap. In position, the cap prevents spurting of water from the nozzle, and ensures a drip-like feed which can be more accurately positioned. The cap also resists entry of, for example, soil which could block the valve, without blocking water outflow.

FIG. 3 also shows an optional head 30 having a conical end 31 extending from a square-section shaft 32. The shaft can be push-fitted into circular-section inlet length 15 of the valve passageway, and the conical head 31 will facilitate the insertion of the valved nozzle into preformed openings in the wall of the pipe 11, and may be used to pierce openings in pipes of suitable material which have not been pre-perforated. The head 30 can remain in position after insertion of the nozzles, as water can pass between the flats on the shaft and the bore of the length 15. The head should not dislodge in use, due to the grip on the shaft and as the point of the head end 31 may extend almost across the diameter of the pipe 11.

Figure 5:
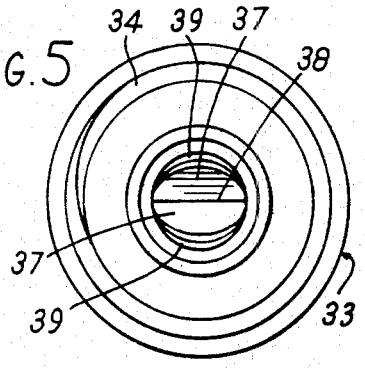
FIG. 5 is a view in the direction of arrow V in FIG. 4.

FIGS. 4 and 5 show a similar valved nozzle 33 which is formed with a threaded length 34 to be screwed into a preformed opening in the wall of a pipe such as 11. Spigots 35 for attaching a cap such as 27, are also useful for rotating the valve body.

Flow through the nozzle passageway 36 is controlled by a pair of vanes or flaps 37. These vanes are each of almost semi-circular form and are angled away from a central zone 38 which, at its ends, is integrally attached to the valve body. In this case, a rise in delivery pressure will cause both vanes to flex and reduce the size of crescent-shaped gaps 39 between the free peripheries of the vanes and the adjacent face of the passageway 36. Again, the angling of the vanes promotes turbulence, and the cross-section of each vane increases towards its distal end.

Figure 6:
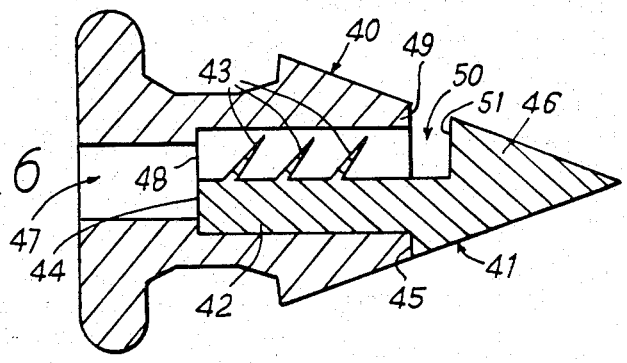
FIG. 6 is a fragmentary cross-section showing an alternative form of nozzle, having a valve insert, in accordance with the present invention.

Referring now to FIG. 6, a similar valved nozzle is produced by providing a possibly conventional nozzle member 40 with a valve insert 41. The insert is a plastics moulding comprising a semi-cylindrical body part 42 from which three outwardly-tapering vanes 43 extend. The insert 41 has an outer end 44, and a shoulder 45 at its conical inner end part 46. Thus, when the insert is push-fitted into stepped passageway 47 of the nozzle member 40, the end 44 and shoulder 45 engage internal annular step 48 in the passageway and inner face 49 of the nozzle member, respectively, so that a gap 50 exists between the face 49 and a staggered shoulder 51 at the conical end part 46. This gap provides access to the passageway 47 which is controlled by the semi-circular vanes 43 coacting with the opposed face of the inner length of the passageway, in a similar manner to the vanes flap 12 of FIGS. 1 and 2 coacting with the opposed face 22 of the passageway.

Figure 7:
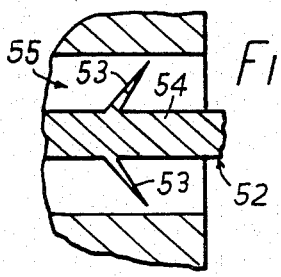
FIGS. 7 and 8 are fragmentary cross-sectional and end views, respectively, of an alternative form of valve insert.
Figure 8:
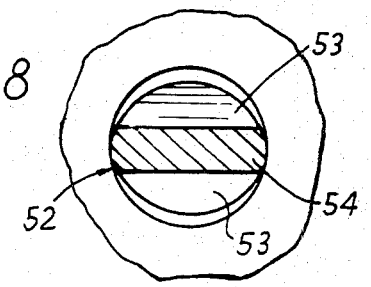

FIGS. 7 and 8 show a form of valve insert 52 which is provided with at least one vane 53 extending from each face of a spatulate central stem 54, to coact with the opposed faces of nozzle passageway 55.

Figure 9:
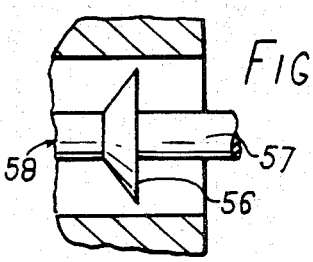
FIG. 9 is a fragmentary cross-sectional view showing another alternative form of valve insert; and, FIG. 10 is a fragmentary end view showing a further alternative form of valve insert.

FIG. 9 shows a form of insert having a frusto-conical vane 56 extending from a circular section stem 57.

Figure 10:
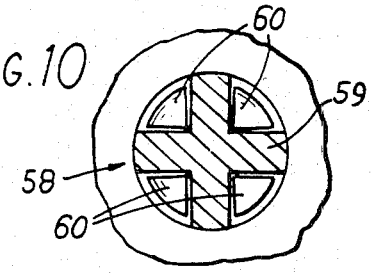

Referring now to FIG. 10, the valve insert 58 has a cruxiform-section stem 59 to which are attached four flexible vanes 60 in the form of quarter segments.

Modifications may be made to the invention, both in the construction of the valve device and in its applications. For example, the vanes may be semicircular, square, oblong, or triangular, and the nozzle bore may be of a section other than circular, the dimentions and the flexibility of the vanes depending on the conditions in which the device is to be applied.

The turbulence of flow at or near the vanes and also the motion of the distal end parts of the vanes produces a self-cleaning action, particularly at or near an innermost restricted flow path.

Returning to FIG. 6 it will be noted that the outermost vane 43 is spaced from the step or shoulder 48 of the nozzle passageway. If, however, it is desired to effect complete closure of the passageway, this vane could be positioned close to the shoulder so that, on a predetermined increase in the water pressure, the vane would engage the shoulder and completely close the nozzle. Also, vanes may be so dimensioned that they can engage the passageway surface to effect closure of the nozzle.

The invention is also applicable in the control of other small-bore liquid systems such as drip-feeds for medical use, or in other fluid flow systems such as the supply of oxygen, again for medical use, or the supply of air in ventilating systems.

I claim:

1. A nozzle used in conjunction with irrigation pipes to provide directed water release from the pipes, the nozzle being easily insertable into an aperture in the wall of a pipe, the nozzle comprising a main body member having a truncated, cone-shaped end portion, a reduced diameter mid portion, a flanged opposite end portion, and an axial passageway of circular cross-section, the passageway having a first portion of a diameter uniform throughout the length of the truncated, cone-shaped portion, and a second portion of a smaller diameter coaxial with the first providing an outlet for the nozzle, the meeting point of the two portions defining an annular step, and a valve device insertable into the first portion of the axial passageway, the valve device having a semicylindrically shaped stem portion and a conically shaped opposite end portion, the stem portion being inserted into the first portion of the axial passageway until the end of the stem abuts the annular step formed in the passageway and the conically shaped portion abuts the truncated, cone-shaped portion of the body, the semicylindrical stem extending beyond the end of the main body to define a gap between the main body and the cone-shaped portion of the valve device so as to provide a water inlet, and flexible vanes extending radially outwardly from the stem portion of the valve device into the direction of fluid flow, the vanes having a semicircular cross-section which corresponds to the inner surface of the passageway and deflect under increased fluid pressure to approach the inner surface of the passageway thereby restricting fluid flow therethrough.

* * * * *